US011015785B1

(12) United States Patent
Schubert

(10) Patent No.: US 11,015,785 B1
(45) Date of Patent: May 25, 2021

(54) LIGHT FIXTURE SYSTEM WITH CONTINUOUS FIRE BARRIER

(71) Applicant: ABL IP Holding LLC, Atlanta, GA (US)

(72) Inventor: Matthew John Schubert, Roselle, IL (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/794,436

(22) Filed: Feb. 19, 2020

(51) Int. Cl.
*F21V 15/01* (2006.01)
*F21V 21/04* (2006.01)

(52) U.S. Cl.
CPC ..... *F21V 15/01* (2013.01); *F21V 21/04* (2013.01)

(58) Field of Classification Search
CPC ..... F21V 15/01; F21V 21/04; F21V 21/30; F21V 25/12; F21V 25/125; F21S 8/02; F21S 8/026
See application file for complete search history.

(56) References Cited

U.S. PATENT DOCUMENTS 6,105,334 A 8/2000 Monson et al.
6,123,438 A 9/2000 Hentz
6,226,939 B1 5/2001 Atkins et al.
6,357,891 B1 3/2002 Newbold et al.
6,838,618 B2 1/2005 Newbold et al.
6,872,885 B1 3/2005 Newbold, Jr.
7,114,294 B2 10/2006 Newbold et al.
7,320,536 B2 1/2008 Petrakis et al.
7,427,147 B2 9/2008 Kovacs
7,470,048 B2 12/2008 Wu
7,476,010 B2 1/2009 Johnson
7,503,145 B2 3/2009 Newbold et al.
7,627,999 B2 12/2009 Latanision
7,651,238 B2 1/2010 O'Brien
7,651,248 B2 1/2010 Hua
7,670,033 B2 3/2010 Steer et al.
7,717,390 B1 5/2010 Rashidi
7,841,135 B2 11/2010 Newbold et al.
7,954,974 B2 6/2011 Johnson
8,333,490 B2 12/2012 Wu
8,517,568 B2 8/2013 Wu
8,629,348 B2 1/2014 Moselle
8,657,473 B2 2/2014 Esmailzadeh
9,335,032 B2 5/2016 Holder et al.
9,512,994 B2 12/2016 Rashidi Doust
9,709,257 B2 7/2017 Wu
9,752,765 B2 9/2017 Rashidi Doust
9,784,443 B2 10/2017 Rashidi Doust
9,797,563 B2 10/2017 Luo et al.
9,803,845 B2 10/2017 Luo et al.
9,890,944 B2 2/2018 Chou
2006/0109612 A1 5/2006 Kovacs
2006/0109660 A1 5/2006 Wolf et al.
(Continued)

*Primary Examiner* — Peggy A Neils
(74) *Attorney, Agent, or Firm* — Kilpatrick Townsend & Stockton LLP

(57) ABSTRACT

Described is a light fixture system having a fixture housing with a base and sidewall that form a housing interior, and a continuous fire barrier element disposed within the housing interior. The continuous fire barrier element may include a central body and at least one flap extending from the central body. The at least one flap may be movable relative to the central body.

16 Claims, 6 Drawing Sheets

(56) References Cited

U.S. PATENT DOCUMENTS

| | | | | |
|---|---|---|---|---|
| 2008/0010907 | A1 | 1/2008 | Moench | |
| 2008/0158862 | A1 | 7/2008 | Wu | |
| 2009/0050338 | A1 | 2/2009 | Kovacs | |
| 2010/0014282 | A1 | 1/2010 | Danesh | |
| 2010/0238670 | A1 | 9/2010 | Moench | |
| 2011/0299280 | A1 | 12/2011 | Maeers | |
| 2014/0102733 | A1 | 4/2014 | Moselle | |
| 2016/0209018 | A1 | 7/2016 | Johnson | |
| 2016/0238225 | A1 | 8/2016 | Rashidi Doust | |
| 2017/0138576 | A1 | 5/2017 | Peng et al. | |
| 2017/0248298 | A1 | 8/2017 | Wu | |
| 2017/0343195 | A1 | 11/2017 | Cadisch et al. | |
| 2017/0350582 | A1 | 12/2017 | Benghozi et al. | |
| 2018/0119905 | A1 | 5/2018 | Luo et al. | |
| 2019/0203894 | A1* | 7/2019 | Zeng | F21V 29/70 |
| 2019/0353340 | A1* | 11/2019 | Green | F21V 25/125 |

* cited by examiner

LIGHT FIXTURE SYSTEM WITH CONTINUOUS FIRE BARRIER

FIELD OF THE INVENTION

Embodiments of the invention relate to a light fixture system, and more specifically a fire rated light fixture system.

BACKGROUND

Current residential and commercial buildings can be constructed in a variety of ways. Regardless of the manner of construction, however, the building must generally comply with certain fire safety standards, such as those set forth by Underwriters Laboratories ("UL"). Very often, it is desired to install various accessories, such as recessed lighting fixtures, into building structures. A recessed lighting fixture typically includes a light element surrounded by a light housing, often referred to as a "can". When installing a recessed lighting fixture, an opening must generally be cut into the ceiling, and once the opening is cut, the recessed lighting fixture can be inserted through the opening and attached to a joist above the ceiling. While the opening in the ceiling accommodates the light fixture, it also may require modifications to the light fixture to meet certain fire safety standards.

SUMMARY

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present disclosure, a light fixture system includes a fixture housing having a base and a sidewall and a continuous fire barrier element. The base and sidewall define a housing interior, the continuous fire barrier element is within the housing interior. The continuous fire barrier element may include a central body and at least one flap extending from the central body. In some aspects, the central body is movable relative to the central body.

The central body and the at least one flap of the continuous fire barrier element may define a barrier chamber. In some cases, the light fixture system may include at least one light source within the barrier.

In some embodiments, an edge of the at least one flap opposite from the central body includes a gripping portion having a concave profile. The continuous fire barrier element may include an intumescent material. In some cases, the central body of the continuous fire barrier element may be adjacent to the base of the fixture housing and the at least one flap of the continuous barrier element may be adjacent to the sidewall of the fixture housing.

According to some embodiments of the present disclosure, the light fixture system includes a fixture housing defining a housing interior and a continuous fire barrier element disposed within the housing interior. The continuous barrier element may include a central body and at least one flap extending from the central body at a non-zero angle.

In some embodiments, the fixture housing includes a base and a sidewall, wherein the base and the sidewall define a housing interior. In various examples, the central body of the continuous barrier element may be adjacent to the base of the fixture housing and the at least one flap of the continuous fire barrier element may be adjacent to the sidewall of the fixture housing.

In some embodiments, the continuous fire barrier element includes an intumescent material.

In various examples, the fixture housing may include a lower plate supporting the fixture housing opposite the base. A light source may be installed within the housing interior. The light fixture system may further include a flame resistant gasket disposed on the lower plate.

In some embodiments, the sidewall defines an opening. The at least one flap may have a blocking configuration and an open configuration. In some cases, in the blocking configuration, the flap may block the opening, and, in the open position, the flap may enable access to the opening.

In some embodiments, the light fixture system includes a secondary housing within the housing interior and adjacent the sidewall. The light source may be positioned within the secondary housing.

According to certain embodiments of the present disclosure, a light fixture system may include a fixture housing defining a housing interior and a continuous fire barrier element disposed within the housing interior. The continuous fire barrier element may include a central body and at least one flap extending from the central body. The at least one flap may be pivotable with respect to the central body within the housing interior.

Various implementations described in the present disclosure can include additional systems, methods, features, and advantages, which can not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
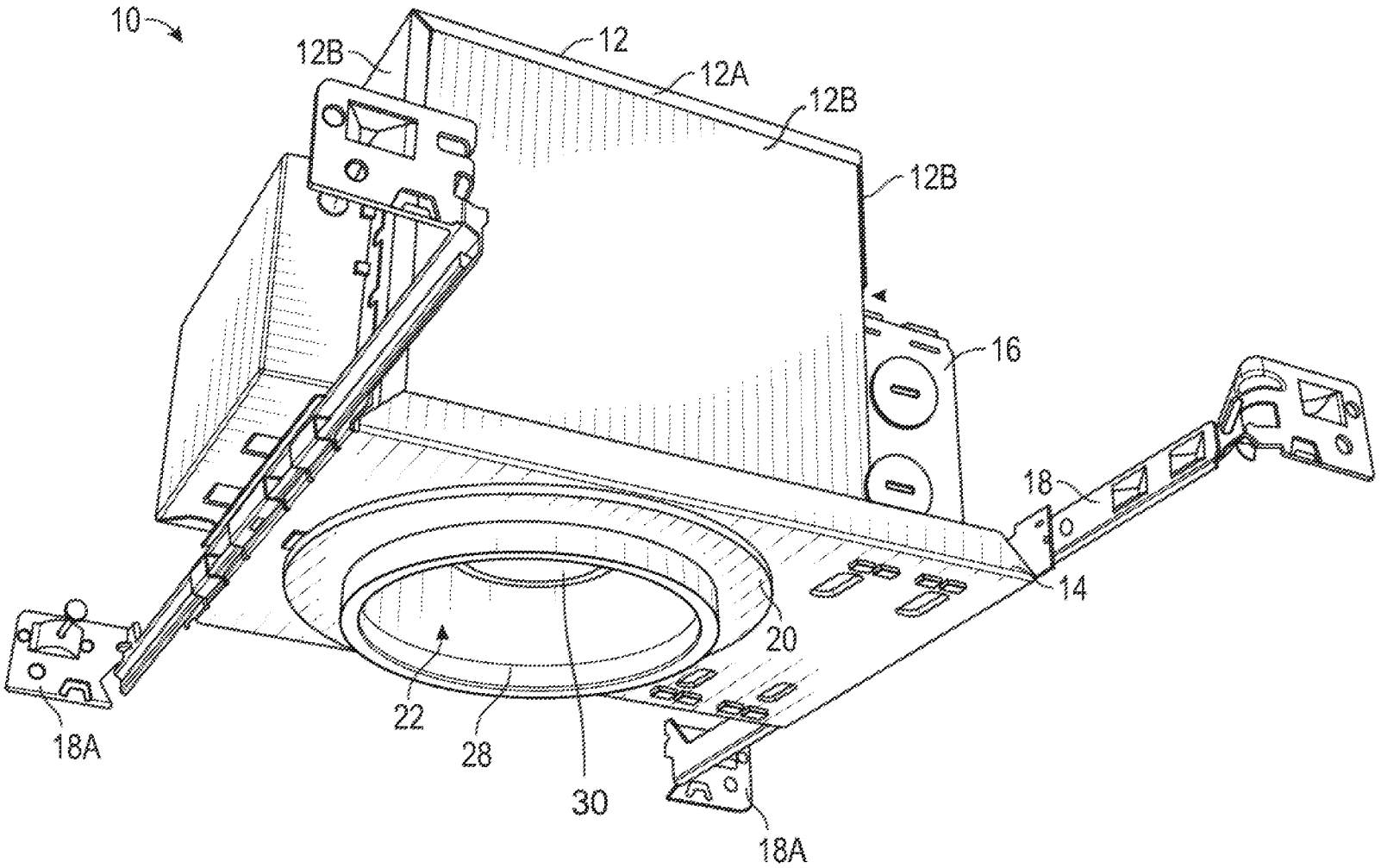
FIG. 1 is a perspective view of a light fixture system according to aspects of the present disclosure.

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present disclosure are generally directed to continuous fire barrier elements and light fixture systems that include continuous fire barrier elements. A light fixture system may generally include a housing, and the continuous fire barrier element may be provided within the housing. The continuous fire barrier elements may each include a central body and at least one flap extending from the central body. As used herein, a "continuous" fire barrier element refers to a unitary element such that the central body and the at least one flap are integrally formed to be a one-piece structure. It will be appreciated that the desired shape of the continuous fire barrier element may depend on a shape of the housing of the light fixture system. As such, while the description below references a particular housing and continuous fire barrier, it will be appreciated that the shape of the light fixture system, components of the light fixture system, and the continuous fire barrier element is not considered limiting on the current disclosure.

FIGS. 1-3B illustrate an example of a light fixture system 10. The light fixture system 10 may include a light source 30, such as light emitting diodes (LED), although it will be appreciated that various other types of light sources may be used (e.g., fluorescent, halogen, incandescent, etc.). In some examples, the light fixture system 10 may be a recessed light fixture positioned within a ceiling, although it need not be recessed in other examples. In some embodiments, the light fixture system 10 includes an fixture housing 12 having an housing interior 12C and a continuous fire barrier element 24 within the housing interior 12C. As discussed in detail below, the continuous fire barrier element 24 may prevent, minimize, or slow the spread of flames and/or heat in the case of a fire, and/or may meet various fire safety standards. In some non-limiting examples, the light fixture system 10 with the continuous fire barrier element 24 may comply with various fire rating standards, including but not limited to Underwriters Laboratory (UL) 263 entitled Standard for Fire Tests of Building Construction and Materials (Jun. 21, 2011) ("UL 263").

In some embodiments, as illustrated in FIGS. 1-3B, the light fixture system 10 includes the fixture housing 12, also referred to as an exterior housing. The fixture housing 12 may include a base 12A and at least one sidewall 12B coupled to the base 12A forming the housing interior 12C. In the example illustrated in FIGS. 1-3B, the fixture housing 12 includes four sidewalls 12B; however, the number of sidewalls 12B should not be considered limiting on the current disclosure. The base 12A may be formed to be an upper portion of the fixture housing 12, and the at least one sidewall 12B may be formed integrally or monolithically with the base 12A, or the at least one sidewall 12B may be a separate component that is coupled to the base. For example, in some cases, the at least one sidewall 12B may be coupled to the base 12A via any suitable attachment means, including, but not limited to, welding, crimping, threaded fastener, or any suitable attachment means. In other examples, the at least one sidewall 12B may be integrally formed with the base 12A. In some embodiments, fixture housing 12 includes a single base 12A, forming the upper portion of the fixture housing 12, and a plurality of sidewalls 12B, forming exterior sides of the fixture housing 12, although as mentioned, the number of bases 12A and sidewalls 12B should not be considered limiting on the current disclosure. The fixture housing 12 may be any suitable shape as desired, and the shape of the fixture housing 12 in FIGS. 1-3B should not be considered limiting on the current disclosure. As one non-limiting example, the fixture housing 12 may have a cross-sectional shape of a square, as illustrated in FIGS. 1-3B. As other non-limiting examples, the cross-sectional shape of the fixture housing 12 may be an oval, triangle, rectangle, circle, semi-circle, pentagon, hexagon, octagon, or any other suitable shape as desired.

The fixture housing 12 may be formed from various suitable materials as desired. In some cases, the fixture housing 12 may be constructed from a metal such as steel. In various examples, the material forming the fixture housing 12 may be a durable and/or lightweight material.

The light fixture system 10 may optionally include a junction box 16. In some cases, the junction box 16 may be proximate the fixture housing 12, although it need not be in other examples. The junction box 16 may optionally house various electrical components of the light fixture system 10, including, but not limited to, as wiring connections, drivers, a power supply, etc. as desired.

Figure 2:
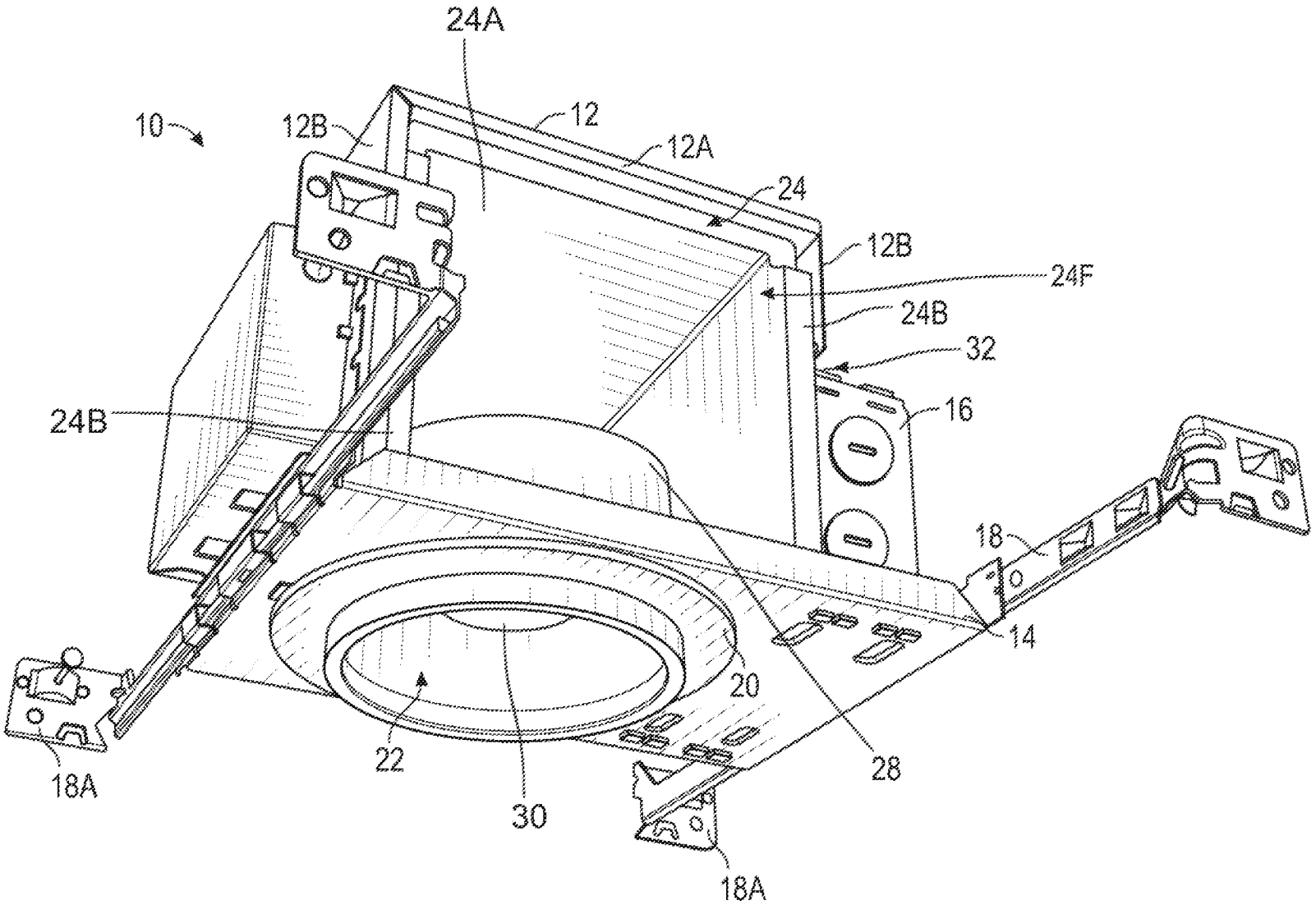
FIG. 2 is another perspective view of the light fixture of FIG. 1 with a sidewall removed.

In some embodiments, and as illustrated in FIGS. 1-2, the light fixture system 10 includes a lower plate 14 that supports the fixture housing 12 and/or the junction box 16. In some optional examples, the lower plate 14 may be coupled to a lower portion of the at least one sidewall 12B of fixture housing 12 opposite the base 12A. In some cases, the lower plate 14 may be coupled to the at least one sidewall 12B via various suitable attachment mechanisms, including, but not limited to, pins, clips, clasps, hooks, magnets, hook and loop fastener, welding, crimping, threaded fastener, or any other suitable attachment means. In some embodiments, the lower plate 14 is removably coupled to the at least one sidewall 12B. Alternatively, the lower plate 14 may be integrally formed with and pivotably coupled to the at least one sidewall 12B. In such examples, a living hinge may optionally be provided between the at least one sidewall 12B and the lower plate 14 such that the sidewall 12B is movable relative to the lower plate 14 while being a unitarily or monolithically formed with the lower plate 14.

As illustrated in FIGS. 1 and 2, the lower plate 14 may include an aperture 22 formed within the lower plate 14. When the fixture housing 12 is supported on the lower plate 14, the aperture 22 may provide access to the housing interior 12C. In some examples, the light source 30 may be installed within the housing interior 12C by inserting the light source through the aperture 22.

In some optional embodiments, the light fixture system 10 includes an a secondary housing 28 positioned within the aperture 22. In various examples, the secondary housing 28 is at least partially within the housing interior 12C. As illustrated in FIGS. 1 and 2, the secondary housing 28 may optionally extend a predetermined distance below the lower plate 14 when the secondary housing 28 is installed. The secondary housing 28 may optionally house the light source 30. In various examples, the secondary housing 28 is supported on the light fixture system 10 such that the secondary housing 28 does not contact a ceiling when the light fixture system 10 is installed. In some cases, and as illustrated in FIGS. 1 and 2, the light fixture system 10 may optionally include a gasket 20 that at least partially surrounds the secondary housing 28. In various examples, the gasket 20 may prevent or minimize contact between the secondary housing 28 and the ceiling when the light fixture system 10 is installed. The gasket 20 may also at least partially surrounds the aperture 22 and prevent or minimize airflow through the aperture 22 between the aperture 22 and the secondary housing 28. The gasket 20 may optionally provide a heat break between the ceiling and the light fixture system 10. The gasket 20 may additionally or alternatively prevent or limit smoke and/or flame penetration. In some examples, the gasket 20 may be constructed from various suitable flame resistant or flame retardant materials as desired.

In some embodiments, the light fixture system 10 includes a mounting system 18 that can be used to support the light fixture system 10 at an installation location (e.g., above a ceiling). In some examples, the mounting system 18 may be a hanger system with hangers 18A, which may be coupled to the lower plate 14 of the light fixture system 10 (or any other suitable location as desired) to suspend and support the light fixture system 10 when installed. In other examples, the mounting system 18 may be various other suitable mounting mechanisms for supporting the light fixture system 10 when installed, including but not limited to, hooks, pins, rods, clips, clasps, wiring, chains, etc.

Referring to FIGS. 2-4B, the light fixture system 10, includes a continuous fire barrier element 24. While a single continuous fire barrier element 24 is illustrated in FIGS. 2-4B, in other examples, any desired number of continuous fire barrier elements 24 may be utilized. The continuous fire barrier element 24 may comprise a central body 24A and at least one flap 24B extending from the central body 24A. In the examples of FIG. 104B, the continuous fire barrier element 24 includes four flaps 24B extending from the central body 24A. However, the continuous fire barrier element 24 may include any desired number of flaps 24B as desired, and the number of flaps 24B should not be considered limiting on the current disclosure. The at least one flap 24B may be pivotable or foldable (represented by arrow A in FIG. 3A) with respect to the central body 24A such that the at least one flap 24B may at various orientations relative to the central body 24A. For examples, the at least one flap 24B is pivotable such that the at least one flap 24B may be substantially parallel to the central body 24A, at a non-zero angle relative to the central body 24A, or various other orientations as desired. In other examples, the at least one flap 24B may include sub-portions, and each sub-portion of the at least one flap 24B may be foldable or pivotable relative to other sub-portions of the at least one flap 24B and/or the central body 24A.

The at least one flap 24B may optionally include a gripping portion 24C. Where a plurality of flaps 24B are provided, a single flap 24B may include a gripping portion 24C or a plurality of flaps 24B may include a gripping portion 24C. In the example of FIGS. 1-4B, two flaps 24B include a gripping portion 24C. The gripping portion 24C may be formed along an edge 24E of the at least one flap 24B opposite the central body 24A. In some embodiments, the gripping portion 24C may be optionally be a cutout and may have a concave profile or semi-circle shape; however, the gripping portion 24C may have any suitable shape, and the shape of the gripping portion 24C should not be considered limiting on the current disclosure. The gripping portion 24C may allow the user to grasp the at least one flap 24B as desired and position the at least one flap 24B at a desired orientation relative to the central body 24A.

The continuous fire barrier element 24 may be constructed from various suitable fire resistant materials, including but not limited to mineral wool, fiber materials, endothermic materials, refractory materials, or any other suitable fire resistant material. In some examples, the continuous fire barrier element 24 may be an intumescent material, including but not limited to a coating (e.g., paint), putty, fiber, rubber, plastic, or any other suitable intumescent material. In some cases, the continuous fire barrier element 24 may comply with various fire rated standards, including but not limited to UL 263.

Figure 4A:
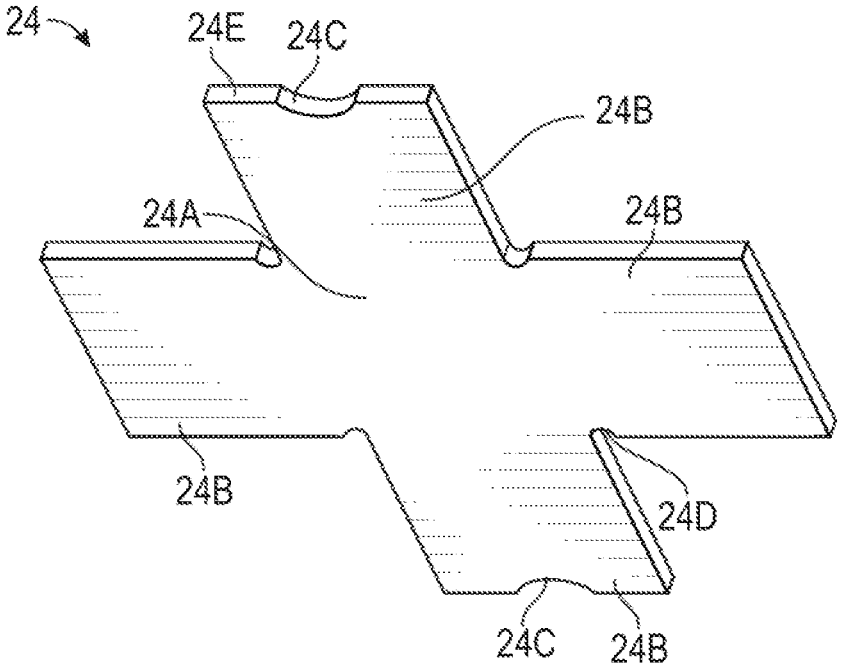
FIG. 4A is a plan view of a continuous fire barrier element of the light fixture of FIG. 1 in an unassembled state.
Figure 4B:
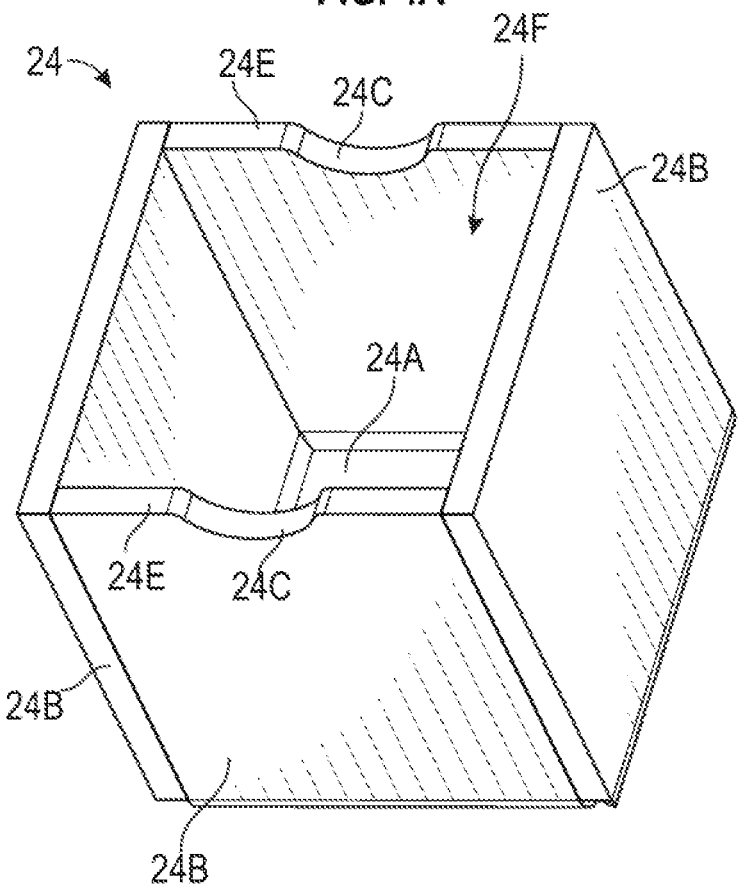
FIG. 4B is a perspective view of the continuous fire barrier element of the light fixture of FIG. 1 in an assembled state.

As illustrated in FIGS. 4A and 4B, in addition to having the at least one flap 24B being pivotable relative to the central body 24A, the continuous fire barrier element 24 may be movable between an unassembled configuration (FIG. 4A) and an assembled configuration (FIG. 4B). As illustrated in FIG. 4A, in the unassembled configuration, adjacent flaps 24B may be spaced apart from each other, and, as illustrated in FIG. 4B, in the assembled configuration, adjacent flaps 24B may be adjacent to each other and optionally may contact each other. In the unassembled configuration, the continuous fire barrier element 24 may optionally lay in a single plane such that the central body 24A and the at least one flap 24B are coplanar. In other examples, the at least one flap 24B need not be coplanar with the central body 24A in the unassembled configuration. In various examples, in the assembled configuration, the at least one flap 24B may be at a non-zero angle from the central body 24A. In some embodiments, the at least one flap 24B extends at an angle of approximately 90°. However, in other examples, the at least one flap 24B may extend various other angles with respect to the central body as desired. In various examples, the continuous fire barrier element 24 may be in the assembled configuration prior to being positioned within the housing interior 12C, although it need not be in other examples.

The at least one flap 24B at the non-zero angle relative to the central body 24A may define a barrier chamber 24F. Referring to FIG. 4A, in some embodiments, the continuous fire barrier element 24 may include a notch 24D in a corner between the at least one flap 24B and the central body 24A. The notch 24D may allow for increased bendability or movement of the at least one flap 24B relative to the central body 24A. The notch 24D may also allow for the continuous fire barrier element 24 to form various shapes in the assembled configuration. As illustrated in FIG. 4A, in some examples, the notch 24D may have a rounded profile. However, the notch 24D may have other suitable profiles or shapes as desired, and the shape or profile of the notch should not be considered limiting on the current disclosure. In various examples, the notch 24D may or may not be visible when the continuous fire barrier element 24 is in the assembled configuration.

Referring back to FIGS. 2 and 3, when the continuous fire barrier element 24 is disposed within the housing interior 12C, the central body 24A may be positioned proximate the base 12A of the fixture housing 12 and the at least one flap 24B may be positioned proximate the at least one sidewall 12B of the fixture housing 12. A gap 26 may optionally be formed between the continuous fire barrier element 24 and a portion of the fixture housing 12 (e.g., a portion of the base 12A and/or a portion of the at least one sidewall 12B). The gap 26 may allow for easier installation of the continuous fire barrier element 24 within the housing interior by providing space that account for a variation in sizes of the continuous fire barrier element 24. In some examples, the gap 26 may allow for selective expansion of the continuous fire barrier element 24, such as when the continuous fire barrier element 24 is exposed to heat and expands, thereby filling the gap 26 and creating a char barrier to prevent flames from spreading. While the continuous fire barrier element 24 is illustrated within the housing interior 12C, in other examples, at least a portion of the continuous fire barrier element 24 may be disposed outside of the housing interior 12C. In one non-limiting example, the secondary housing 28 may be positioned within the barrier chamber 24F such that the secondary housing 28 is spaced apart from the at least one flap 24B thereby defining a gap between the at least one flap 24B and the secondary housing 28. In other non-limiting examples, the secondary housing 28 may contact the at least one flap 24B.

Figure 3A:
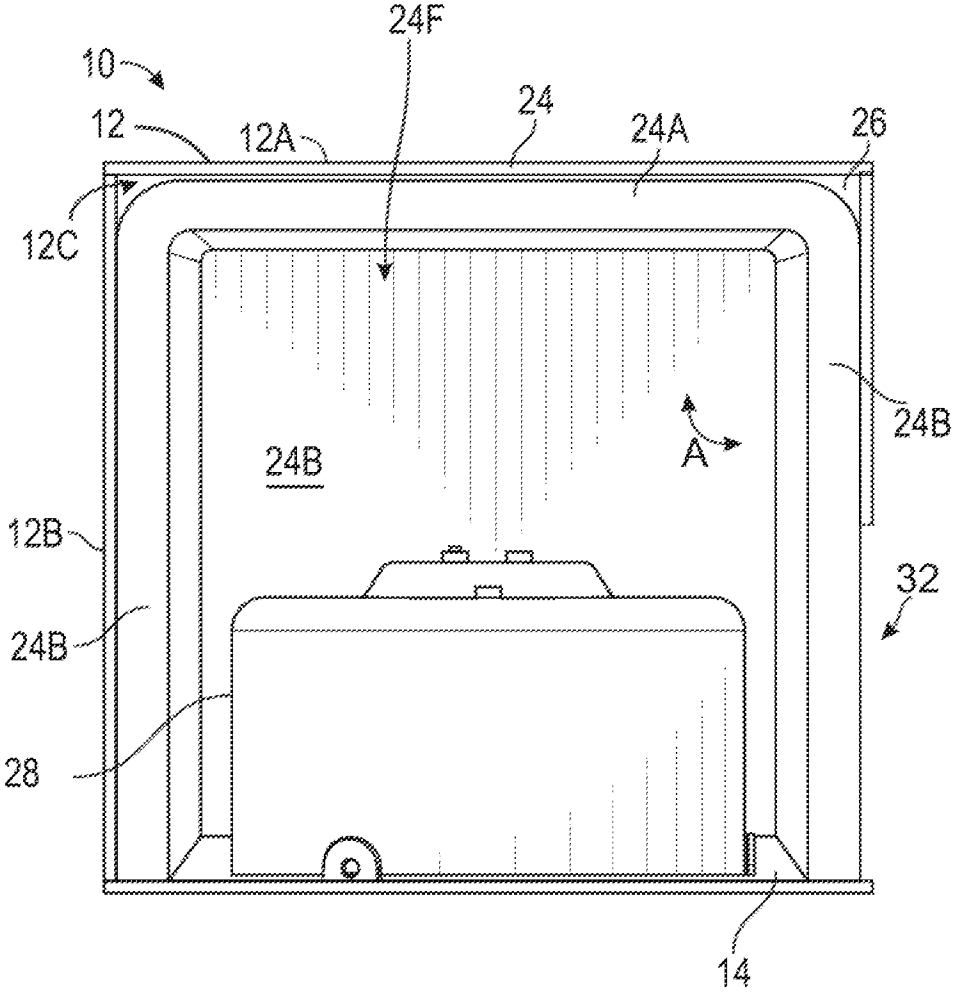
FIGS. 3A-3B are cross-sectional views of the light fixture of FIG. 1.
Figure 3B:
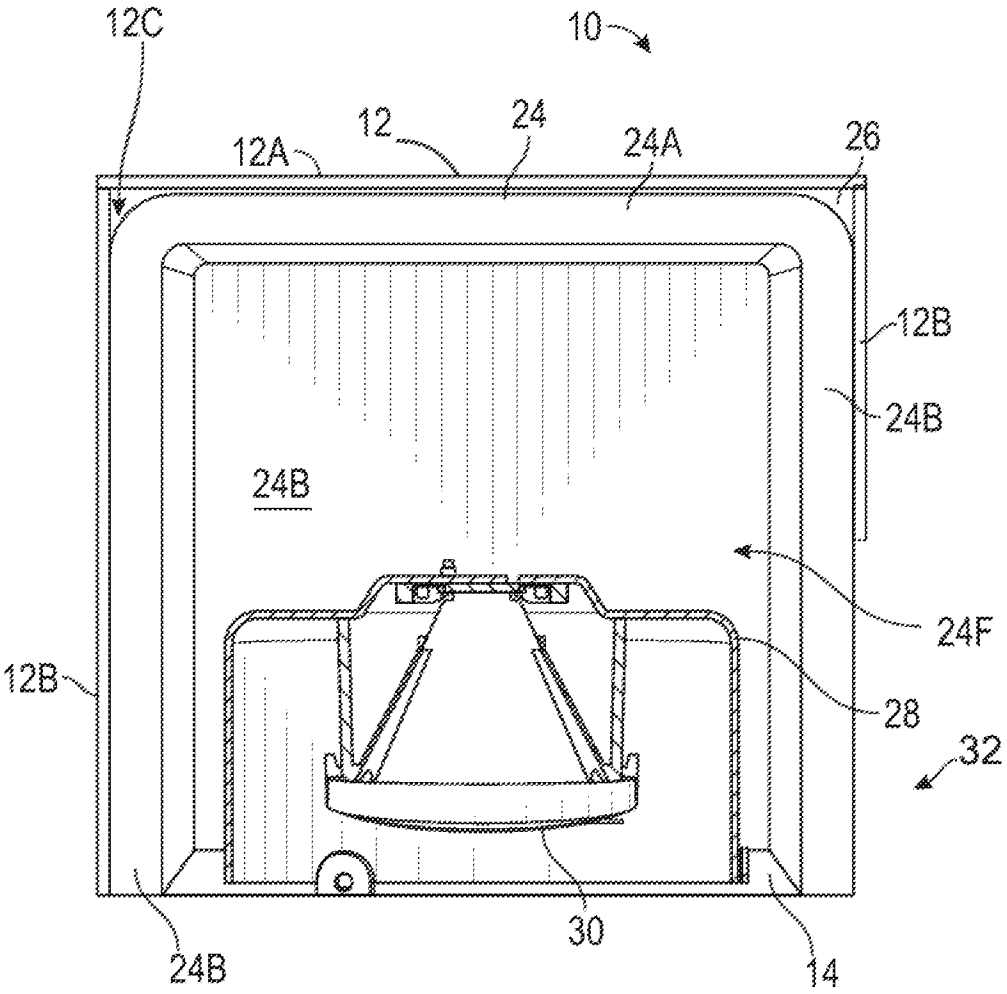

While the continuous fire barrier element 24 is within the housing interior 12C, the at least one flap 24B may be selectively moved or pivoted to various orientations relative to the central body 24A while remaining continuous with the central body 24A. In some examples, the at least one flap 24B may be selectively moved relative to an opening 32 defined in the at least one sidewall 12B (which may provide access to an exterior of the fixture housing 12, the junction box 16, etc.). For example, referring to FIG. 3A, the continuous fire barrier element 24 may have a blocking configuration and an open configuration relative to the opening 32. In the blocking configuration, and as illustrated in FIG. 3A, the at least one flap 24B may block the opening 32 formed in the at least one sidewall 12B of the fixture housing, thereby blocking or limiting access through the opening 32. When the opening 32 provides access to an adjacent electrical feature (e.g., the junction box 16), the at least one flap 24B in the blocking configuration may limit or prevent access from the housing interior 12C, through the opening 32, and into the junction box 16. In the open configuration, the at least one flap 24B may be pivoted (represented by arrow A in FIG. 3A) with respect to the central body 24A thereby enabling access to and through the opening 32. In some optional examples, the at least one flap 24B may be moved towards the central body 24A when the at least one flap 24B is moved from the blocking configuration to the open configuration.

Figure 5A:
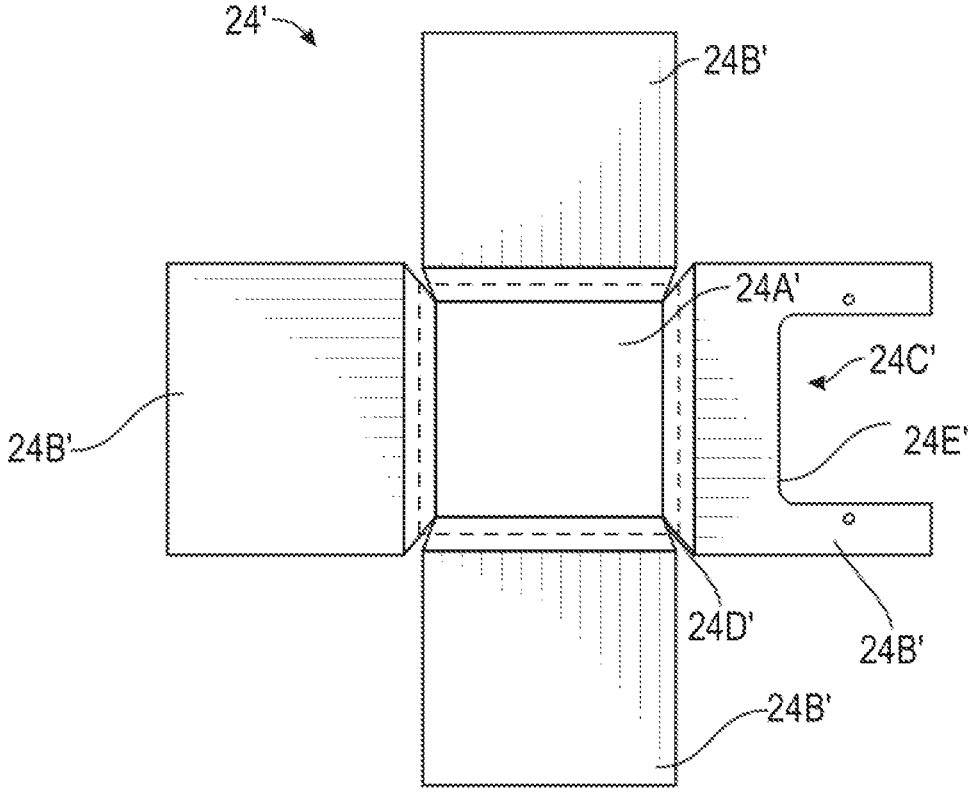
FIG. 5A is a plan view of another continuous fire barrier element in an unassembled state, according to another embodiment of the present invention.
Figure 5B:
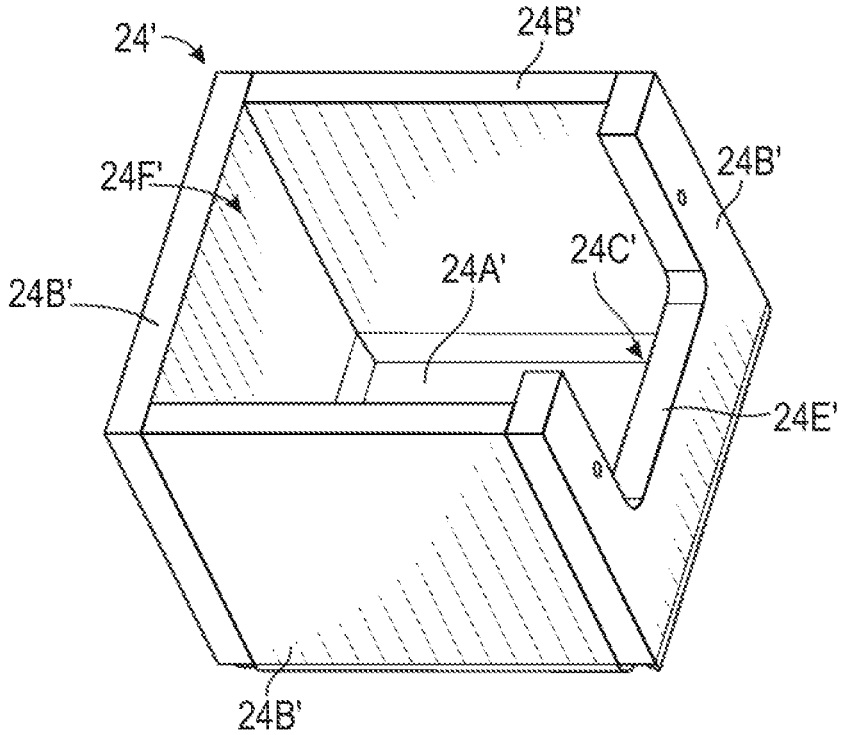
FIG. 5B is a perspective view of the continuous fire barrier element of FIG. 5A in an assembled state.

FIGS. 5A and 5B illustrates another example of a continuous fire barrier element 24' according to other embodiments of the present invention. The continuous fire barrier element 24' is substantially to the continuous fire barrier element 24 except that the continuous fire barrier element includes an opening 24C' defined in the edge 24E' of at least one of the flaps 24B' rather than the gripping portion 24E. The opening 24C' may be provided on one flap 24B'; alternatively, the opening 24C' may be provided on multiple flaps 24B'. When included, the opening 24C' may allow a user to access the opening 32 of the fixture housing 12 when the continuous fire barrier element 24' is in the assembled state. In some optional examples, the opening 24C' may be aligned with the opening 32 of the sidewall 12B such that the user can access the junction box or other adjacent electrical feature without having to pivot the at least one flap 24B'. The shape or profile of the opening 24C' should not be considered limiting on the current disclosure.

In addition, compared, compared to the continuous fire barrier element 24, the continuous fire barrier element 24' of FIGS. 5A and 5B includes a notch 24D' having a different profile from the notch 24D'. In particular, in the example of FIGS. 5A and 5B, the notch 24D' has triangular, or V-shape, profile. As described above, the notch 24D' may be shaped to have any suitable profile as desired.

In some aspects, the continuous fire barrier element described herein may be formed as a one piece flat design rather than being formed of individual sheets. This one piece flat design may eliminate assembly variability thereby eliminating potential failure points that may be created by the variability found by using individual sheets. In another aspect, the continuous fire barrier element may allow for a user to access the light housing without having to remove the continuous fire barrier element. By pivoting a flap of the continuous barrier element rather than removing individual sheets, the continuous barrier element may retain integrity of the material and further eliminate potential failure points during maintenance. The pivotable flap may also allow for more usable volume within the light fixture.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Examples of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

Different arrangements of the components depicted in the drawings or described above, as well as components and steps not shown or described are possible. Similarly, some features and sub-combinations are useful and may be employed without reference to other features and sub-combinations. Examples of the invention have been described for illustrative and not restrictive purposes, and alternative examples will become apparent to readers of this patent. Accordingly, the present invention is not limited to the examples described above or depicted in the drawings, and various examples and modifications may be made without departing from the scope of the claims below.

That which is claimed is:

1. A light fixture system comprising:

a fixture housing having a base and a sidewall, the base and the sidewall defining a housing interior;

a continuous fire barrier element within the housing interior, the continuous fire barrier element comprising:
a central body;
at least one flap extending from the central body;
wherein the at least one flap is movable relative to the central body;
wherein an exterior surface of the central body of the continuous fire barrier element directly contacts an interior surface of the base of the fixture housing; and
wherein an exterior surface of the at least one flap of the continuous fire barrier element contacts an interior surface of the sidewall of the fixture housing;
wherein the at least one flap is movable relative to the central body while the continuous fire barrier element is disposed within the housing interior.

2. The light fixture system of claim 1, wherein, the central body and the at least one flap of the continuous fire barrier element define a barrier chamber, and wherein the light fixture
system further comprises at least one light source within the barrier chamber.

3. The light fixture system of claim 1, wherein an edge of the at least one flap opposite from the central body comprises a gripping portion, and wherein the gripping portion comprises a concave profile.

4. The light fixture system of claim 1, wherein the continuous fire barrier element comprises an intumescent material.

5. A light fixture system comprising:
a fixture housing having a base and at least one sidewall, the base and the at least one sidewall defining a housing interior;
a continuous fire barrier element disposed within the housing interior, wherein the continuous fire barrier element comprises:
a central body;
at least one flap extending from the central body at a non-zero angle;
wherein an exterior surface of the central body of the continuous fire barrier element directly contacts an interior surface of the base of the fixture housing;
wherein an exterior surface of the at least one flap of the continuous fire barrier element contacts an interior surface of the sidewall of the fixture housing; and
wherein the at least one flap is movable relative to the central body while the continuous fire barrier element is disposed within the housing interior.

6. The light fixture system of claim 5, wherein the continuous fire barrier element comprises an intumescent material.

7. The light fixture system of claim 5, wherein the fixture housing further comprises a lower plate supporting the fixture housing, and wherein a lighting source is installed within the housing interior.

8. The light fixture system of claim 7, further comprising a flame resistant gasket disposed on the lower plate.

9. The light fixture system of claim 5, wherein the at least one sidewall defines an opening, wherein the at least one flap is movable between a blocking configuration and an open configuration;
wherein, in the blocking configuration, the at least one flap blocks the opening defined in the sidewall of the fixture housing; and
wherein, in the open configuration, the at least one flap is spaced apart from the opening defined in the sidewall and provides access to the opening.

10. The light fixture system of claim 5, further comprising a secondary housing within the housing interior and adjacent the sidewall; and
wherein a light source is positioned within the secondary housing.

11. A light fixture system comprising:
a fixture housing having a base and at least one sidewall, the base and the at least one sidewall defining a housing interior;
a continuous fire barrier element disposed within the housing interior, wherein the continuous fire barrier element comprising:
a central body;
at least one flap extending from the central body;
wherein the at least one flap is pivotable with respect to the central body within the housing interior;
wherein a surface of the central body contacts the base of the fixture housing and a surface of the at least one flap contacts the at least one sidewall of the fixture housing; and
wherein the at least one flap is movable relative to the central body while the continuous fire barrier element is disposed within the housing interior.

12. The light fixture system of claim 11, wherein:
a top surface of the central body of the continuous fire barrier element directly contacts an interior surface of the base of the fixture housing and;
an exterior surface of the at least one flap of the continuous fire barrier element directly contacts an interior surface of the at least one sidewall of the fixture housing.

13. The light fixture system of claim 12, wherein the continuous fire barrier element comprises an intumescent material.

14. The light fixture system of claim 12, further comprising a lower plate coupled at a lower portion of the fixture housing opposite the base, wherein a lighting source is installed within the housing interior.

15. The light fixture system of claim 14, further comprising a flame resistant gasket disposed on the lower plate.

16. The light fixture system of claim 12, wherein the at least one sidewall defines an opening, wherein the at least one flap has a blocking configuration and an open configuration;
wherein, in the blocking configuration, the at least one flap blocks the opening defined in the sidewall of the of the fixture housing; and
wherein, in the open configuration, the at least one flap is spaced apart from the opening defined in the sidewall of the fixture housing and provides access to the opening.

* * * * *